US011415353B2

(12) United States Patent
Jensen

(10) Patent No.: US 11,415,353 B2
(45) Date of Patent: Aug. 16, 2022

(54) ICE CUBE PRODUCING AND/OR DISPENSING UNIT

(71) Applicant: Icebreaker Nordic ApS, Aalborg (DK)

(72) Inventor: Kim Jensen, Aalborg (DK)

(73) Assignee: Icebreaker Nordic ApS, Aalborg (DK)

( * ) Notice: Subject to any disclaimer, the term of this patent is extended or adjusted under 35 U.S.C. 154(b) by 0 days.

(21) Appl. No.: 16/610,822

(22) PCT Filed: May 4, 2018

(86) PCT No.: PCT/EP2018/061554
§ 371 (c)(1),
(2) Date: Nov. 4, 2019

(87) PCT Pub. No.: WO2018/202874
PCT Pub. Date: Nov. 8, 2018

(65) Prior Publication Data

US 2020/0064047 A1 Feb. 27, 2020

(30) Foreign Application Priority Data

May 4, 2017 (DK) ..... PA201770310

(51) Int. Cl.
*F25C 5/20* (2018.01)
*F25C 1/24* (2018.01)

(52) U.S. Cl.
CPC ..... *F25C 5/20* (2018.01); *F25C 1/24* (2013.01); *F25C 2305/022* (2013.01); *F25C 2400/10* (2013.01); *F25C 2400/14* (2013.01)

(58) Field of Classification Search
CPC ..... F25C 5/20; F25C 5/24; F25C 2400/04; F25C 1/24; F25C 2305/022;
(Continued)

(56) References Cited

U.S. PATENT DOCUMENTS 3,744,679 A * 7/1973 Nitschneider ..... F25C 5/20 222/238
3,967,722 A * 7/1976 Dietert ..... B65G 33/265 198/659

(Continued)

FOREIGN PATENT DOCUMENTS

CH 579894 A5 9/1976
KR 10-2008-015351 * 12/2008 ..... F25C 5/00

(Continued)

OTHER PUBLICATIONS

International Search Report in PCT/EP2018/061554 dated Oct. 22, 2018 (5 pages).

*Primary Examiner* — Cassey D Bauer
(74) *Attorney, Agent, or Firm* — Bookoff McAndrews, PLLC

(57) ABSTRACT

An ice cube dispensing unit comprising a housing suitable for containing at least two ice cubes, and a dispensing mechanism arranged at one end of the housing. The dispensing mechanism comprises an opening which is large enough for the ice cubes to pass through, a wall arranged near an edge of the opening, and an ice cube displacing mechanism suitable for displacing the ice cubes out of the housing through said opening. The ice cube displacing mechanism and the wall are arranged such that the ice cubes pass between the wall and the ice cube displacing mechanism on their way out of the housing. The ice cube displacing mechanism is arranged at a distance from the wall such that the minimum distance A between the wall and an outer periphery of the ice cube displacing mechanism is less than the minimum dimension of the ice cubes and either the wall and/or the outer periphery of the ice cube displacing mechanism is displaceable to allow the distance A to increase to allow ice cubes to leave the housing. An invention related to
(Continued)

ejecting ice cubes from an ice cube tray and an invention related to filling an ice cube tray with liquid are also disclosed.

10 Claims, 8 Drawing Sheets

(58) Field of Classification Search
CPC ..... F25C 2400/10; F25C 2400/14; B65F 2207/00; B65G 2207/00
See application file for complete search history.

(56) References Cited

U.S. PATENT DOCUMENTS

| | | | | |
|---|---|---|---|---|
| 2005/0150906 | A1* | 7/2005 | Ishigure ..... | F25C 5/24 222/146.6 |
| 2013/0214010 | A1 | 8/2013 | McCoy | |
| 2017/0023287 | A1 | 1/2017 | Son et al. | |

FOREIGN PATENT DOCUMENTS

| | | | |
|---|---|---|---|
| WO | WO 2007/077166 | A2 | 7/2007 |
| WO | WO 2016/055495 | A1 | 4/2016 |

* cited by examiner

ICE CUBE PRODUCING AND/OR DISPENSING UNIT

CROSS-REFERENCE TO RELATED APPLICATIONS

This application is the U.S. national phase entry under 35 U.S.C. § 371 of International Application No. PCT/EP2018/061554, filed on May 4, 2018, which claims benefit to Denmark Patent Application No. PA201770310, filed May 4, 2017.

The current specification discloses inventions which are related to units for producing and/or dispensing ice cubes.

It is to be noted that the embodiments shown in this specification relate to ice cube producing and dispensing units. However, some of the inventions disclosed herein can be used either in an ice cube producing unit or in an ice cube dispensing unit or in a combined ice cube producing and dispensing unit.

Furthermore, the embodiments disclosed in the current specification relate for the most part to "hand held" ice cube producing and dispensing units. In other words, units which can be operated directly by a user while the user holds the unit in his or her hands. This is in contrast to a refrigerator mounted unit which is known in the prior art. When a device needs to be hand held, a number of restrictions are placed on the device with regards to size, weight, strength, functionality and cost. Many of the challenges experienced when making a hand held device are not present in current ice cube producing and dispensing units mounted in the refrigerators.

It should however be noted that while the embodiments shown in this specification relate mainly to hand held units, the principles of the inventions disclosed herein could also be used with non hand held units. Hence, unless specifically noted, the claims should not be limited to hand held units. It is however noted that the claims could in the future be limited to hand held units if this is desired by the applicant.

DESCRIPTION OF RELATED ART

Ice cube trays are well known in the art. Likewise, there are many disclosures of ice cube bags. However both ice cube trays and ice cube bags are difficult and/or annoying to use. Ice cube producing and dispensing units which are built into fridges have therefore been used for many years. These units are however large, bulky, expensive, noisy and require cleaning/maintenance once in a while.

Recently, the current applicant has designed a hand held ice cube producing and dispensing unit which has the benefits of a typical fridge mounted unit but provided in a smaller hand held package. This type of hand held unit has a number of advantages with respect to the known ice cube machines. Applicant's previous patent application WO2016/055495 is incorporated herein in its entirety by reference.

However, a number of additional challenges were discovered by the applicant during the applicant's testing and development. It was discovered that filling the unit with water was problematic in some situations. Likewise, it was discovered that ejecting ice cubes from ice cube trays was in certain conditions difficult. Likewise it was discovered that dispensing ice cubes using a dispenser having a very low build height was difficult.

SUMMARY OF THE INVENTION

Hence, one aspect of a first invention disclosed herein is to provide an ice cube dispensing unit which allows for easy dispensing of ice cubes with a dispenser having a very low build height.

One aspect of a second invention disclosed herein is to provide an ice cube producing unit where the ice cubes can be ejected from the trays in a robust and repeatable manner.

One aspect of a third invention disclosed herein is to provide an ice cube producing unit which can be filled with liquid in an easier and faster manner.

These aspects are provided at least in part by the independent claims provided in the attached claim set. Additional interesting embodiments are disclosed in the dependent claims and in the description provided below.

It should be noted that as mentioned above, this specification discloses multiple inventions. As such, divisional applications directed to the additional inventions could be filed in the future.

It should be emphasized that the term "comprises/comprising/comprised of" when used in this specification is taken to specify the presence of stated features, integers, steps or components but does not preclude the presence or addition of one or more other features, integers, steps, components or groups thereof. For example, if a claim claims a first and a second compartment, then any number of additional compartments could also be imagined.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
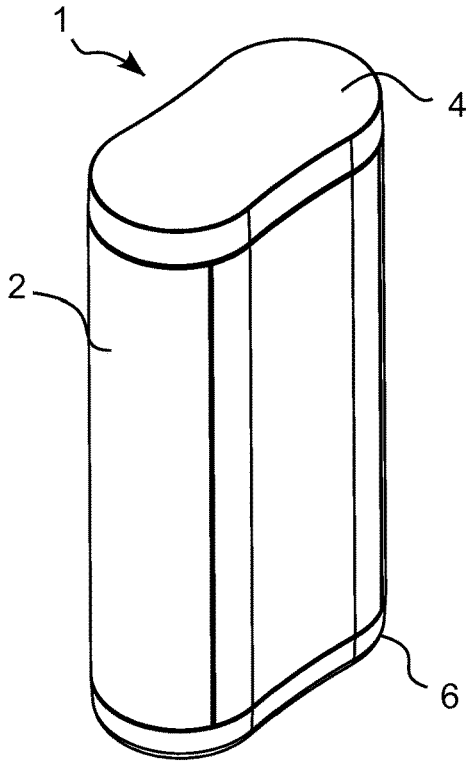
FIG. 1 shows a top perspective view of one embodiment of a handheld ice cube producing and dispensing unit comprising features of the inventions disclosed in this specification.
Figure 2:
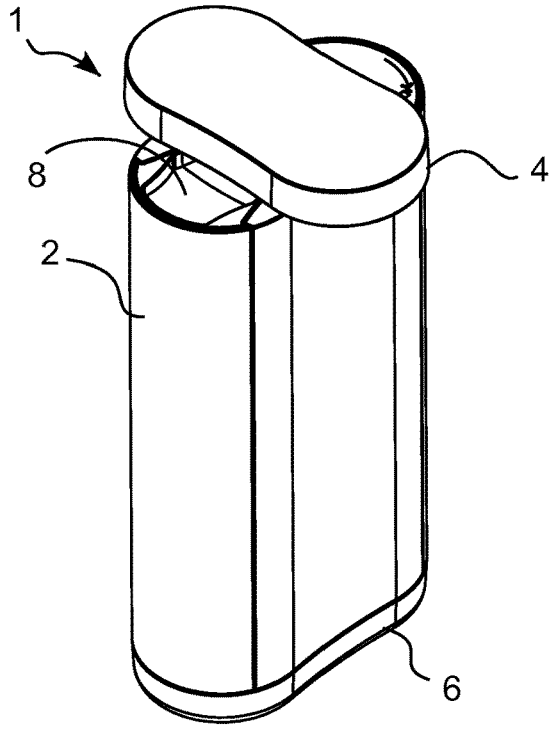
FIG. 2 shows a top perspective view of the hand held ice cube producing and dispensing unit of FIG. 1 in a filling configuration.
Figure 3:
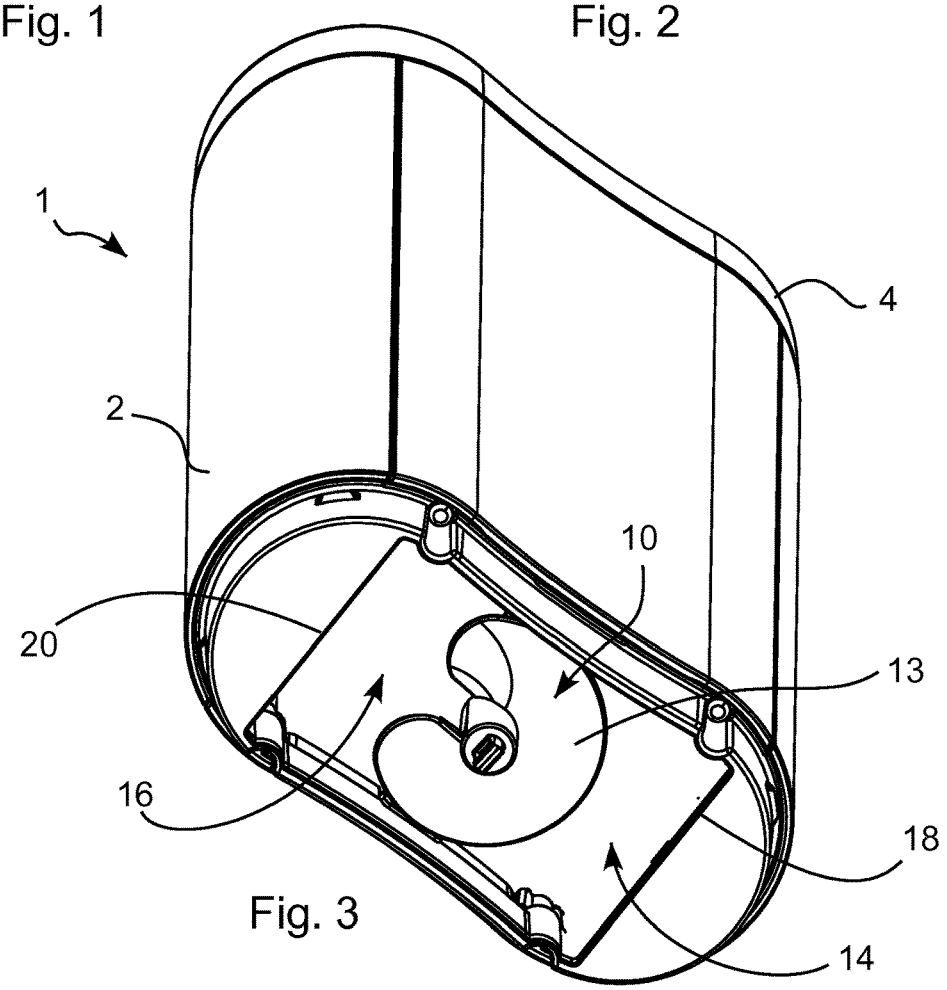
FIG. 3 shows a bottom perspective view of the hand held ice cube producing and dispensing unit of FIG. 1 where the dispensing mechanism is shown.
Figure 4A:
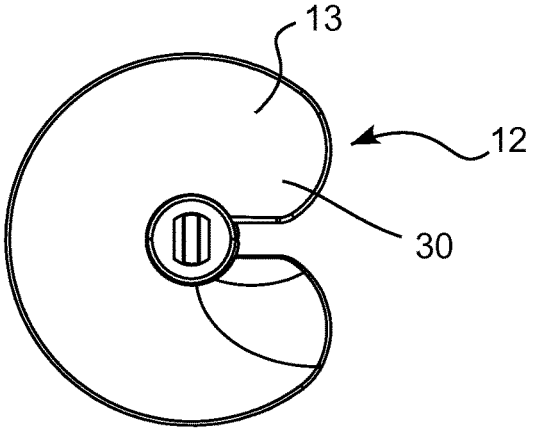
FIGS. 4*a*-4*d* show top, front, side and top perspective views respectively of the driving element shown in FIG. 3.
Figure 4B:
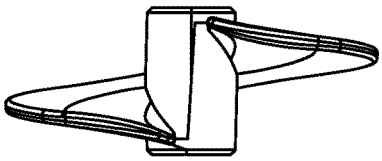
Figure 4C:
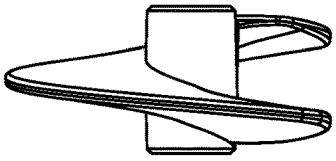
Figure 4D:
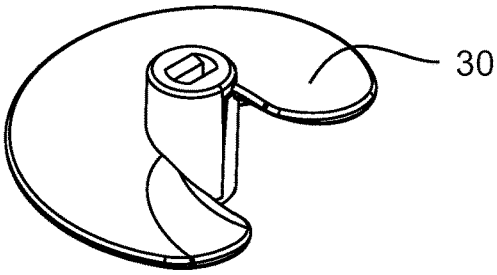

The ice cube producing and dispensing unit 1 shown in FIGS. 1-3 is a hand held unit comprising a housing 2, a top lid 4 and a bottom lid 6. The top lid can be rotated as shown in FIG. 2 to reveal a filling tray 8 through which water or other liquid can be poured to fill the unit. Once the unit is filled with water, the unit can be closed by rotating the lid back to its closed position. The closed unit can then be placed in a freezer and after a suitable amount of time, the liquid inside the unit will have frozen. The bottom lid 6 can then be removed to expose a dispenser mechanism 10 in the bottom of the unit as shown in FIG. 3. The top lid 4 can then be rotated to activate the dispenser mechanism. By activating the dispenser mechanism, one ice cube at a time will be dispensed from the unit. In this way, a unit is provided which is easy to fill, easy to freeze and easy to dispense.

It should be noted that for the sake of simplicity, some of the internal details of the unit have been removed in FIGS. 2 and 3.

Figure 20:
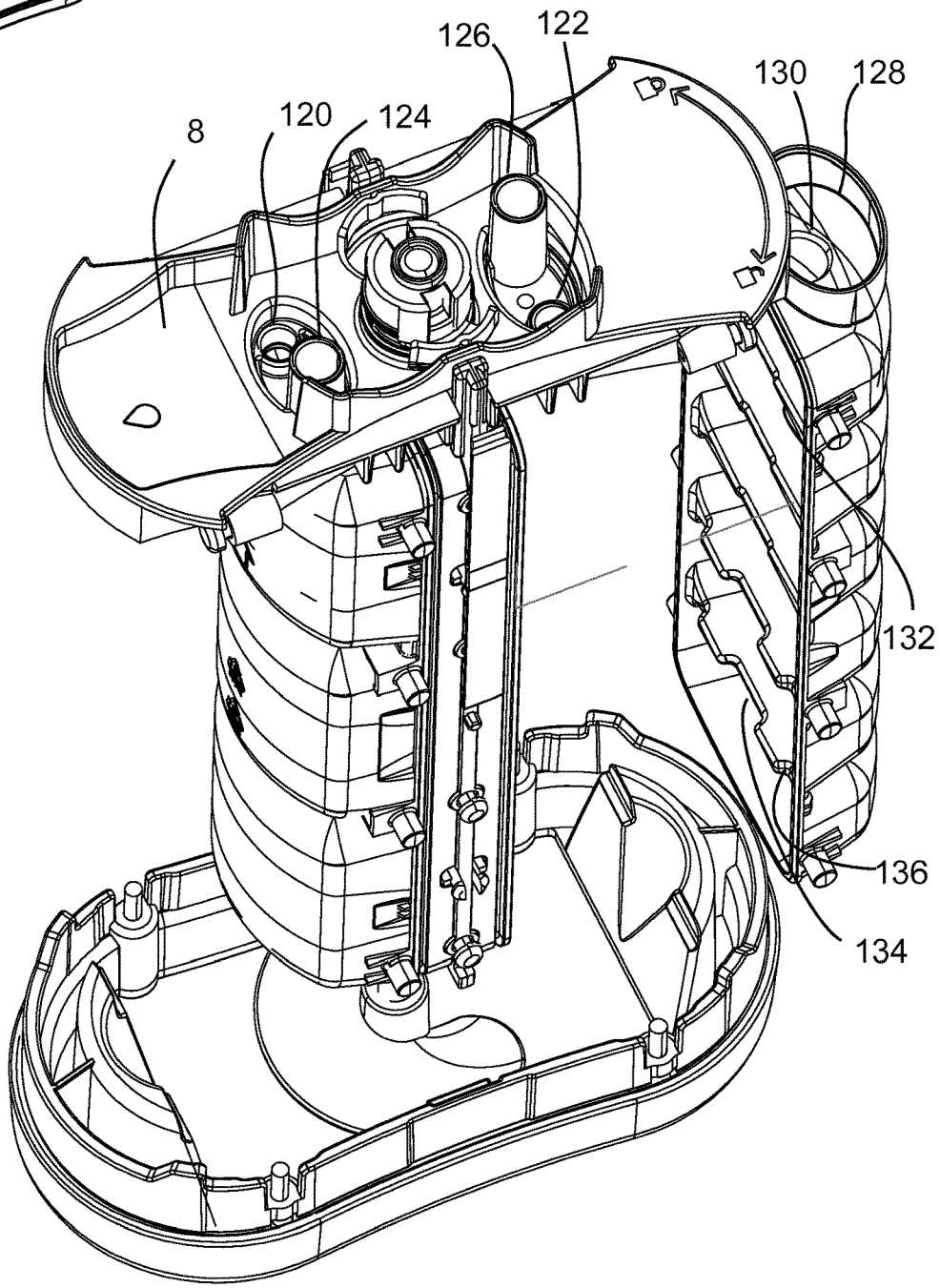
FIG. 20 shows an exploded view of the portion of the ice cube producing and dispensing unit shown in FIG. 19 furthermore with the upper lid removed.

As can be seen from FIG. 3, the dispensing mechanism comprises a driving element 12 in the form of a rotating element with a helical flange 13. The driving element 12 is centred between two openings 14,16, one opening arranged on either side of the driving element 12. The two openings are defined on one side by a wall element 18,20 and on the other side by the driving element 12. The walls are slightly angled with regards to the vertical as can be seen in FIG. 20 such that the lower ends of the walls are closer together than the upper ends of the walls. In this way, ice cubes present in the housing 2 will be funnelled between the walls and out through one of the two openings.

It should be noted that when reference are made to orientation, for example upper, lower, etc., the orientation of the unit shown in FIG. 1 should be used.

FIGS. 4*a*-4*d* show different detailed views of the driving element 12 of FIG. 3. The dispensing element is manufactured from a silicon based material which makes the helical flange 13 of the dispensing element flexible. When the helical flange 13 encounters an obstruction, for example an ice cube, the helical flange can bend up or down without damaging the helical flange.

Figure 5A:
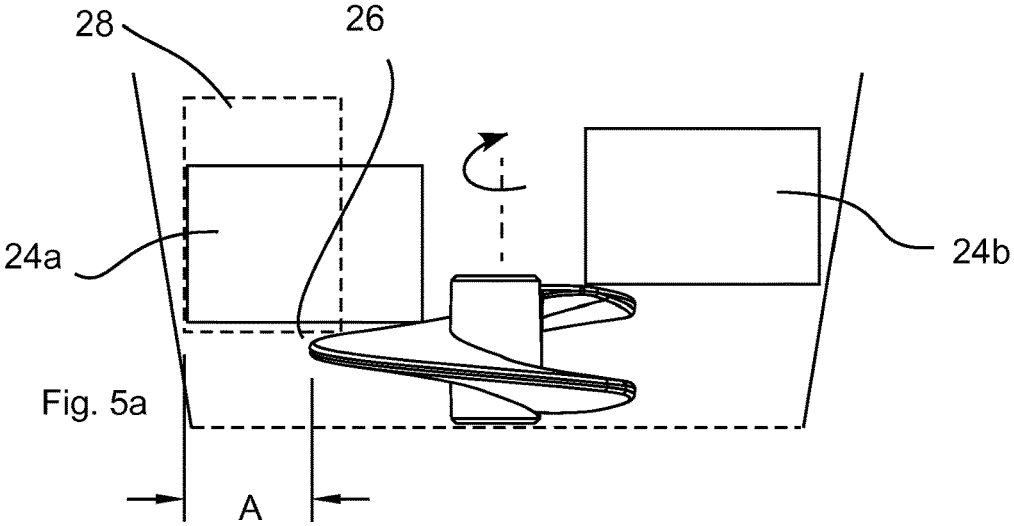
FIGS. 5*a*-5*b* schematically show how the dispensing mechanism of FIG. 3 functions.
Figure 5B:
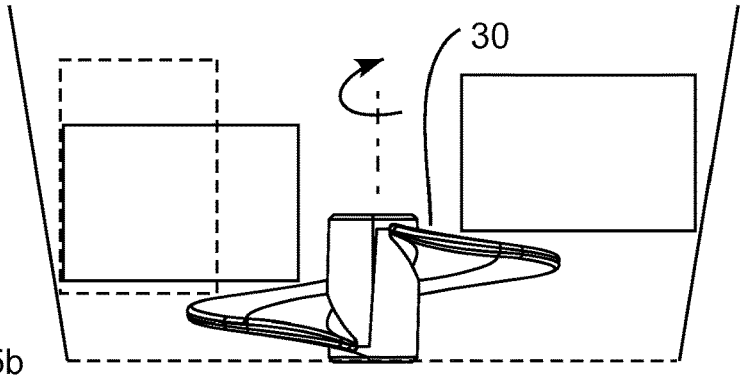
Figure 6A:
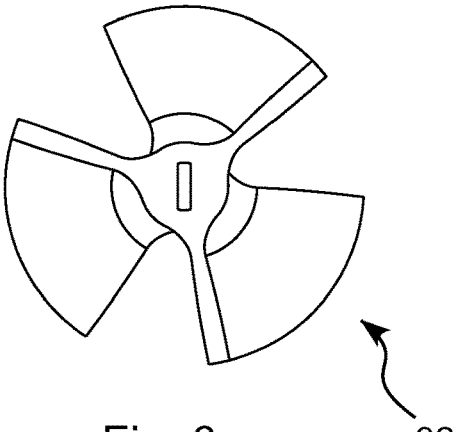
FIGS. 6*a*-6*d* show top, front, side and top perspective views respectively of another embodiment of a driving element suitable for an ice cube dispensing unit.
Figure 7A:
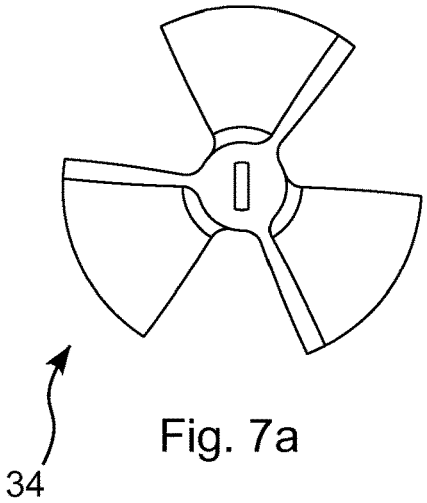
FIGS. 7*a*-7*d* show top, front, side and top perspective views respectively of another embodiment of a driving element suitable for an ice cube dispensing unit.
Figure 6B:
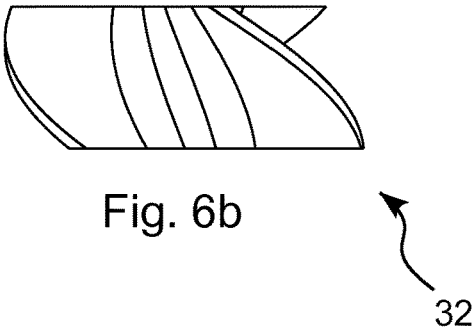
Figure 7B:
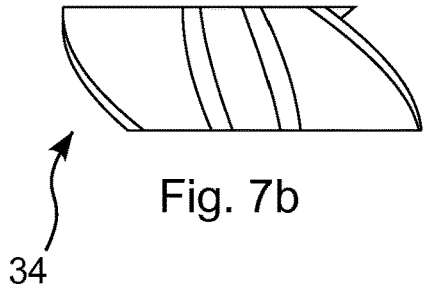
Figure 6C:
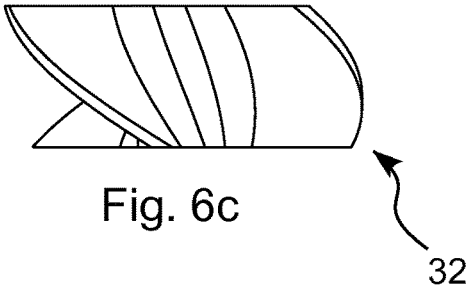
Figure 7C:
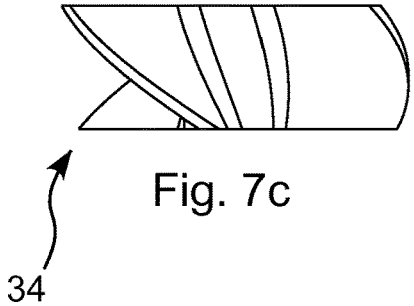
Figure 6D:
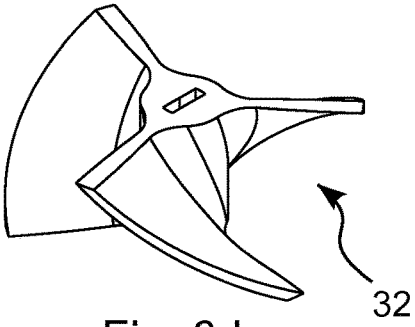
Figure 7D:
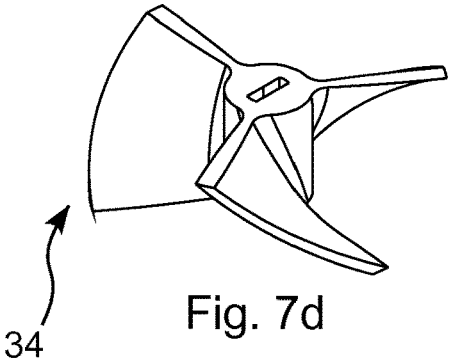

FIGS. 5*a* and 5*b* show the function of the dispensing mechanism of FIG. 3 in a schematic manner. In FIG. 5*a*, two ice cubes 24*a*,24*b* are contained in the housing and above the driving element 12. The ice cubes have a width W which is wider than the distance A between the wall and the outer edges 26 of the helical flanges. In this way, when an ice cube is ready to fall out of the housing, the flanges of the driving element will catch the ice cube as is shown in FIG. 5*a*. In the case where the ice cube has different dimensions, then the distance A is shown to be smaller than the minimum dimension of the ice cube. In FIG. 5*a*, an ice cube 28 is shown in dashed lines which has arrived in an upright position which presents a narrower face to the dispensing mechanism.

As the driving element is rotated, the ice cubes will slowly move down as can be seen by comparing FIGS. 5*a* and 5*b*. However, as the helical flanges rotate and the ice cube moves further down, the helical flanges will engage with the sides of the ice cube. For example, if the driving element in FIG. 5*b* rotates some more, then the upper part 30 of the flange will engage with the side of the right side surface of the left most ice cube 24*a*. The upper part of the flange will then bend upwardly as the dispensing element is rotated some more. As the flange is bent upwardly, a force will be applied to the ice cube which will force the ice cube in a downwards direction as the driving element rotates more. As such, the driving element can be understood as a form of element which drives the ice cubes downwardly.

Once the ice cube has passed the minimum width point in the opening, then the ice cube falls out of the housing.

The driving element 12 of the embodiment shown in FIG. 3 comprises a single helical flange with an angular extension of a bit less than 360 degrees. However, other forms of dispensing element could also be provided. FIGS. 6*a*-6*d* show a second embodiment 32 of a driving element and FIGS. 7*a*-7*d* show a third embodiment 34 of a driving element. Both the second and third embodiments comprise three flanges which are arranged at a much steeper angle when compared to the first embodiment of the driving element 12. Each flange only has an angular extension of around 60 degrees. The second embodiment has a slightly longer angular extension and a lower angle when compared to the third embodiment. The optimal arrangement of the driving element will be dependent on the size and form of the ice cube, how the ice cubes are delivered to the dispensing mechanism and the angle and form of the wall in relation to the driving element.

FIGS. 8 to 13 show some different conceptual embodiments of other dispensing mechanisms which are covered by the claims.

Figure 8:
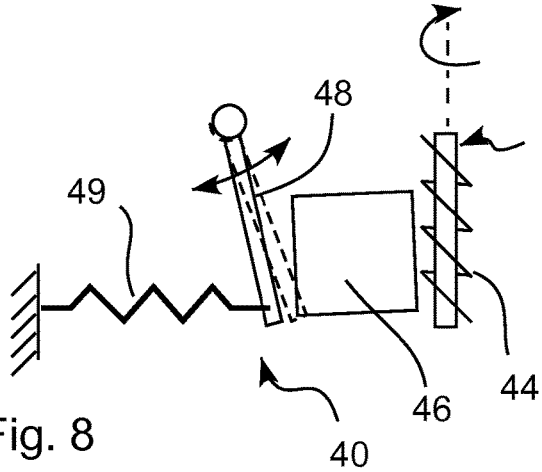
FIGS. 8-13 schematically show conceptual embodiments of additional ice cube dispensing mechanisms which are similar in function to the embodiment shown in FIG. 3.

FIG. 8 shows an embodiment 40 with a driving element 42 having a helical flange 44 extending along the length of the driving element. In this embodiment, the helical flange is made of a stiff material which can engage more firmly with the sides of the ice cube 46. The wall portion 48 is in this case spring biased via a spring mechanism 49 in towards the driving element. In this way, the distance A between the wall and the outer periphery of the driving element is less than the minimum dimension of the ice cube. When the driving element engages with the ice cube and starts to push the ice cube downwardly, the wall will be pushed out to the side to allow the ice cube to pass the driving element. In this case, the wall can be considered displaceable and the driving element is fixed in position. In one embodiment, instead of a stiff wall being spring biased via a spring mechanism, a flexible wall can be provided which has an integral spring bias effect. For example a flap of a pliable material can be provided to block the opening. As the driving element rotates, the pliable flap is pushed to the side. When the ice cube falls through the opening, the pliable flap bounces back to catch the next ice cube coming through the dispensing mechanism.

Figure 9:
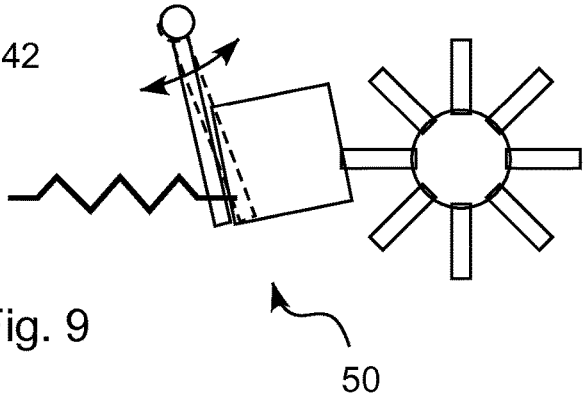
Figure 10:
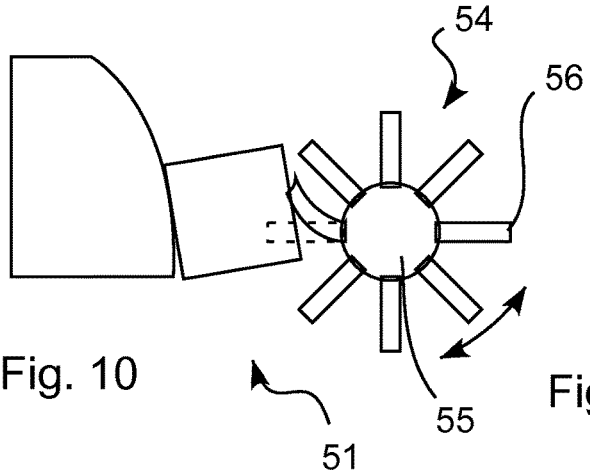
Figure 11:
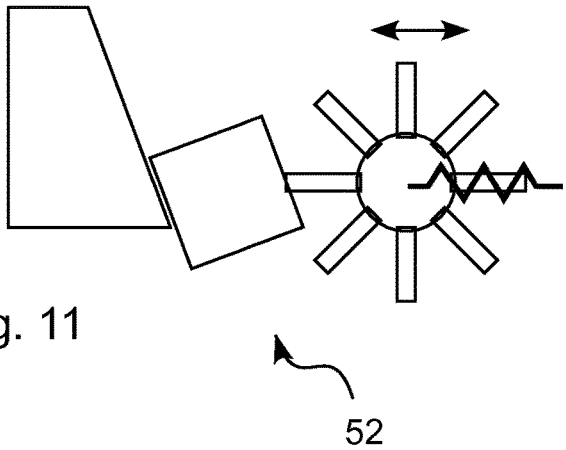

FIGS. 9, 10 and 11 show three embodiment 50,51,52 having a slightly different principle. Instead of the driving element rotating about a vertical axis, in this case the driving element 54 rotates about a horizontal axis. The dispensing element comprises a hub portion 55 and flanges 56 extending from the hub portion in a radial direction. This could be imagined to be similar to a paddle wheel. In the figures, the flanges are shown as large paddle like elements. However, the flanges could be formed in many different ways.

In the embodiment 50 of FIG. 9, the flanges are stiff elements and the hub is fixed in position. However, the wall portion is elastically biased to allow the ice cube to push the wall to the side when passing by.

In the embodiment 51 of FIG. 10, the flanges are formed as flexible flanges so that the flanges can deform and deflect when they come into contact with the ice cube.

In the embodiment 52 of FIG. 10, the flanges are stiff and the wall is stiff, but the hub is mounted on a spring loaded axle which allows the entire driving element to displace to the side.

Figure 12:
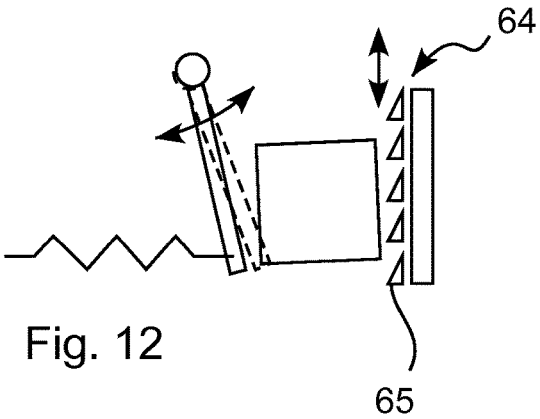
Figure 13:
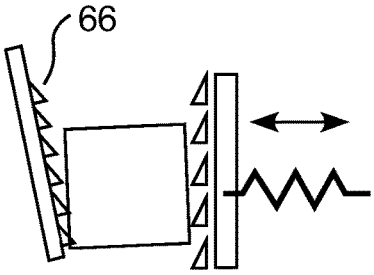

FIGS. 12 and 13 show a different conceptual dispensing mechanism. In both FIGS. 12 and 13, the driving element 64 is a linear reciprocating element with barbs 65 which push the ice cube down when moving down.

When the barbs move up again, due to the angle of the barbs, they slide up past the ice cube without pulling the ice cube back up. In FIG. 12, the linear reciprocating element is fixed in position and the opposing wall is spring loaded, whereas in FIG. 13, the reciprocating element is spring loaded and the wall is fixed in position. In FIG. 13, the wall also has barb elements 66 which ensure even more securely that the ice cube does not move back up when the reciprocating element moves back.

In another embodiment (not shown), a linear reciprocating element could be provided with 2 or more sliding portions arranged beside each other, where when one portion moves down, the other portion moves up. If both portions are provided with barbs, the ice cube will be constantly moved down, even while one of the two portions are moving up. In principle, a concept similar to a walking floor as used in truck trailers with three sets of sliding surfaces could also be used in certain cases.

In general, it should be noted that when providing a dispensing mechanism for a hand held unit, size is important. It is not possible to have an element with a very large height as it needs to fit into the overall housing of the unit without making the unit too large. As such, in many cases, it is desired that the distance A is as large as possible but still small enough to capture the ice cubes. Making the driving element larger, will increase the space necessary to move it. Hence in certain cases, it is desired to make the dimension A greater than 70% of the minimum dimension of the ice cube, greater than 80% of the minimum dimension of the ice cube or greater than 90% of the minimum dimension of the ice cube.

Figure 14:
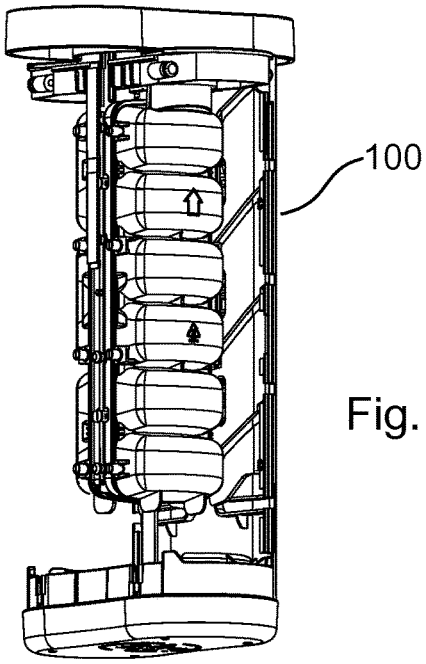
FIG. 14 shows a perspective view of a portion of the ice cube producing and dispensing unit of FIG. 1 with some side panels of the housing removed.
Figure 15:
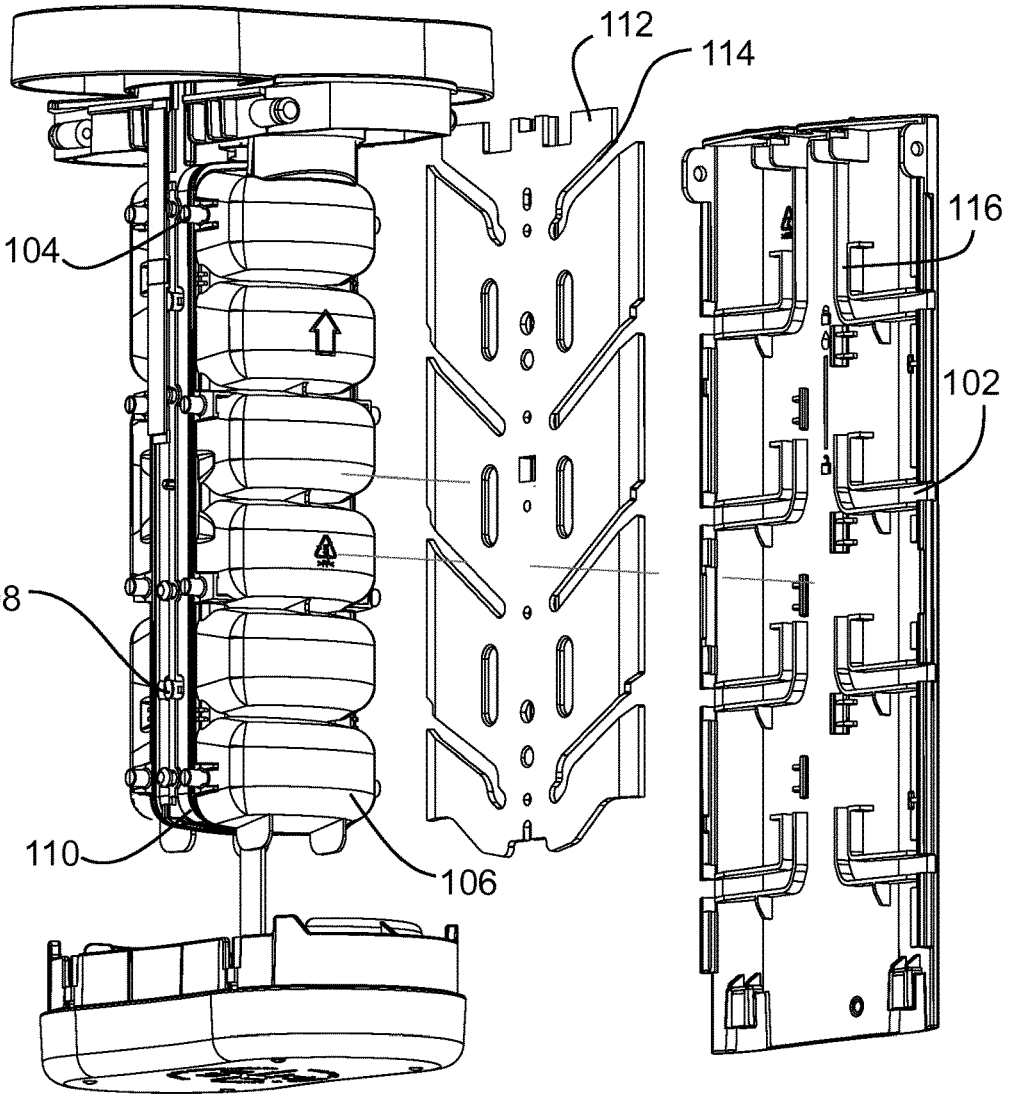
FIG. 15 shows an exploded view of the portion of the ice cube producing and dispensing unit shown in FIG. 14.

FIG. 14 shows a more detailed view of the handheld ice cube producing and dispensing unit of FIG. 1. In this case, the housing has been at least partially removed to show details of the housing. One side wall 100 remains.

It should be noted that the main principle of operation of the unit shown in this specification is similar to the operation of the unit shown in applicant's previous patent application where the operation was described in great detail. Hence, a complete reiteration of the principle of operation will not be repeated here. If there are unclear details, the reader is therefore referred to the applicant's previous application WO2016/055495.

In the side wall 100 are formed tracks 102. Taps 104 connected to the ice cube trays 106 are arranged in the tracks and displace in the tracks when the centre profile 108 is moved up and down. The centre profile 108 comprises the central seals 110, the ice cube trays 106 and the rail panels 112. The taps on the ice cubes are also arranged in the rails 114 in the rail panels 112. The rail panels are connected to the centre profile. When the centre profile starts to move down, the taps on the ice cube trays are arranged in the vertical section 116 of the tracks in side panels. When the bottom of the vertical sections is reached, the taps cannot move any further downwards, and the taps will therefore start to move outwardly as the rail panel moves further down. The ice cube trays will therefore stop moving down and start moving outwardly away from the central seals and the centre profile.

The motion of the individual taps 104 can be controlled individually by adjusting the path of the rails in the rail panels. In this way, it is possible to force the ice cube trays to bend by moving some taps out further than others. In the embodiment according to the current invention, the two taps in the centre are moved out more than the two taps at the ends of the trays. In this way, the trays are bent such that the middle portion of the trays moves further out than the end portions of the trays. This is illustrated in FIG. 16.

This bending is opposite to that which is typically used to get ice cubes out of ice cube trays. In prior art trays, it is typical to bend the tray outwardly so that the ice cubes are pushed out of the tray. However, it was discovered that with the limited amount of travel available in the tray and the limited amount of force available, that bending the tray in the traditional manner, just caused the sides of the tray to press more on the sides of the ice cubes. This prevented the ice cubes from coming out of the compartments. In contrast, by bending the tray inwardly, the walls of the tray are pulled away from the ice cubes and the ice cubes can more naturally fall out of the trays.

Figure 16:
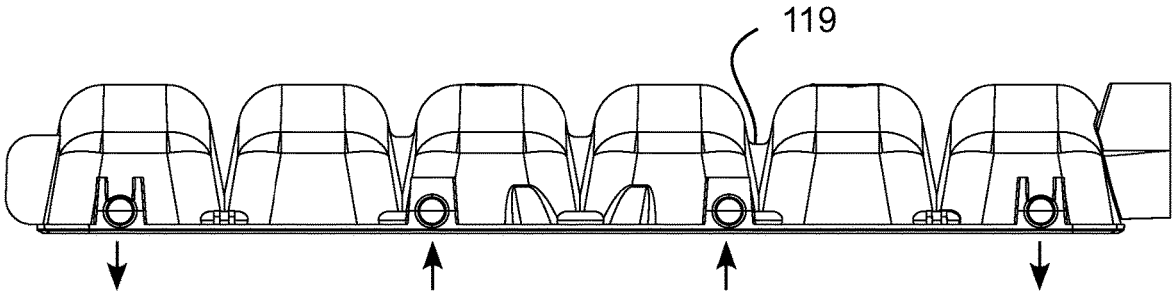
FIG. 16 shows a side view of one embodiment of an ice cube tray used with the ice cube dispensing unit of FIG. 1.
Figure 17:
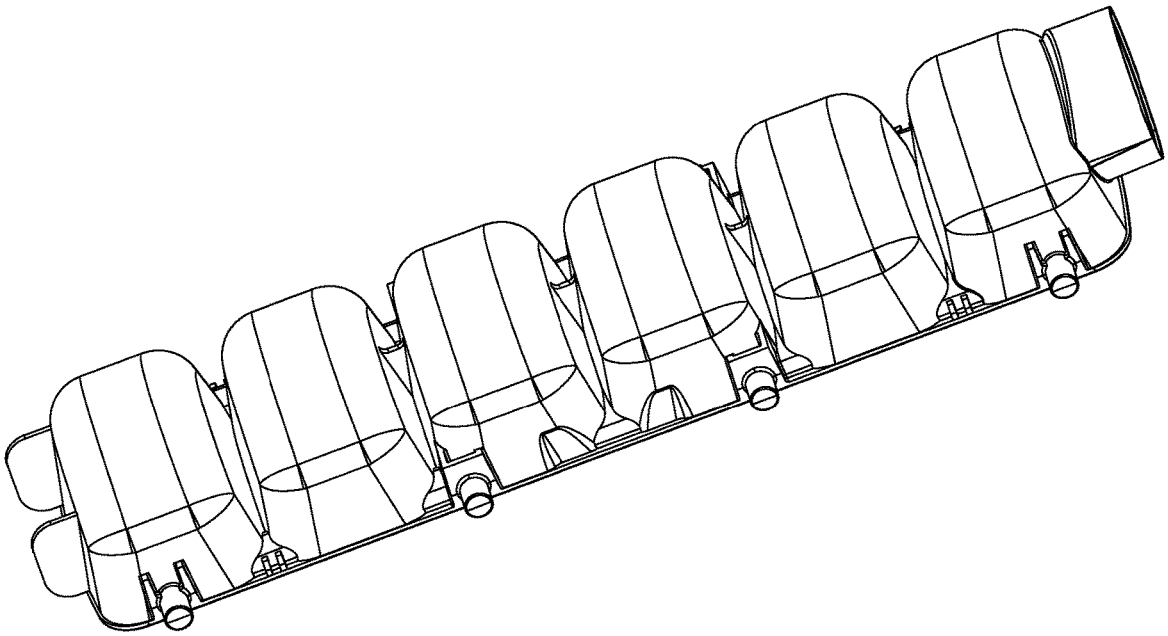
FIG. 17 shows a perspective view showing the bottom of the ice cube tray of FIG. 16.

In FIG. 16 it can be seen that forces are applied to the tray which cause it to bend. In effect the tray can be understood as a beam upon which are placed four point loads. The actual curvature of the tray will therefore be dependent on the geometry of the tray. It was found by the inventor, that if a standard tray was used, it would not bend in an optimal manner since some compartments would bend more than others. This would not cause the walls of all the compartments of the tray to release optimally from the ice cubes. The intersections between separate compartments were therefore custom designed and each intersection can be made slightly different. For example, the central portions are provided with ribs 119 which increase the stiffness, thereby reducing the curvature. Likewise, the outer two compartments are not provided with ribs meaning that they bend more. This allows the actual curvature to be custom designed. The ribs can be seen in more detail in FIG. 17.

Figure 18:
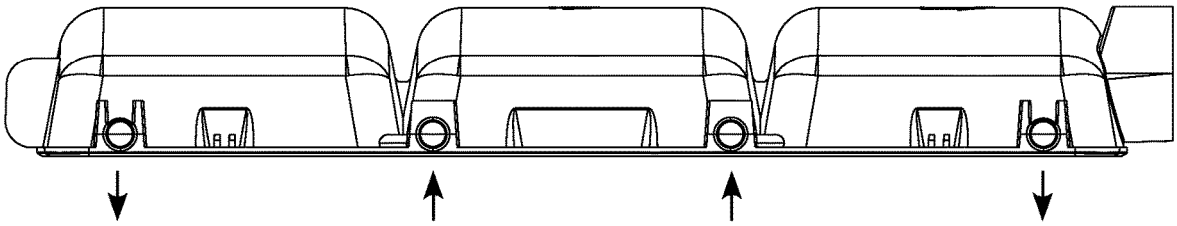
FIG. 18 shows a side view of another embodiment of an ice cube tray used with the ice cube producing and dispensing unit of FIG. 1.

FIG. 18 shows another embodiment of an ice cube tray. In this embodiment, only three compartments are provided, however the compartments are larger and the resulting ice cubes are also larger. The bending moment applies is however the same as with the six compartment ice cube tray.

Figure 19:
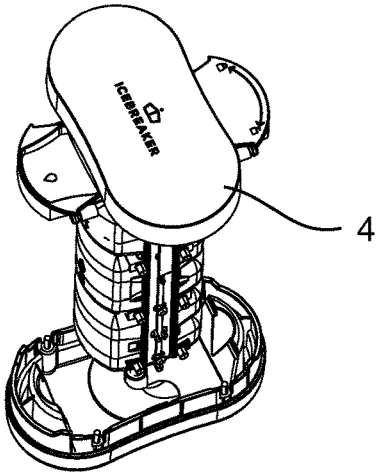
FIG. 19 shows a perspective view of a portion of the ice cube producing and dispensing unit of FIG. 1 with some side panels of the housing and some rail panels removed.

FIG. 19 shows another view of the ice cube producing and dispensing unit 1 again with the sides and the rail panels removed. FIG. 20 shows an exploded view of the version in FIG. 19 furthermore with the top lid removed. It can now be seen that water can be poured into the filling tray 8 in the top portion. Water is distributed in the filling tray to two water filling openings 120,122. Next to the water filling openings 120,122 are air venting chimneys 124,126. It is a very important feature that as water flows into the closed ice cube trays, air needs to be able to exit the enclosed volume. The water filling openings have a first flow coefficient. As the water flows through the first opening, it pours into a chamber 128 which comprises a second filling opening 130. This second filling opening has a flow coefficient which is greater than that of the first opening. In this way, more water will pour through the second opening than is poured through the first opening. Hence, the chamber will never fill up with liquid while the tray is not full and air leaving the tray can exit through the same hole 130 as the water is entering the tray since the hole will never be blocked.

It can also be seen from the figures, that there are openings 132 between adjacent compartments in the ice cube tray. These openings are also sized so that they are larger than the first opening 122. In this way, as water enters the tray, water will never fill up in one compartment until the compartment below it is completely filled.

It should be noted that a similar effect could be provided by pouring only a small amount of water into the filling tray. However, this would require that the user controls the water flow into the tray in a controlled manner. By balancing the sizes of the openings as discussed here, the user can just pour in as much water as he/she wants without causing any blockage of the filling.

Figure 21:
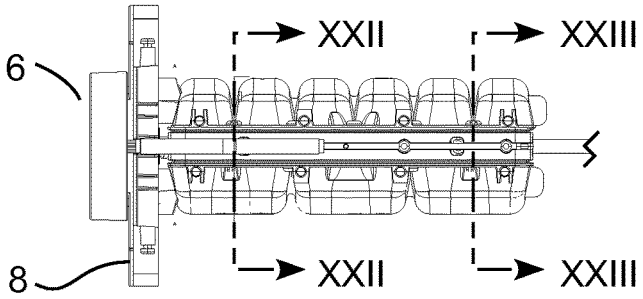
FIG. 21 shows a side view of a portion of the ice cube producing and dispensing unit shown in FIG. 19.

FIG. 21 shows a portion of the unit shown in FIG. 19, but where the bottom portion has been removed. The part to the left is the top lid 6.

Figure 22:
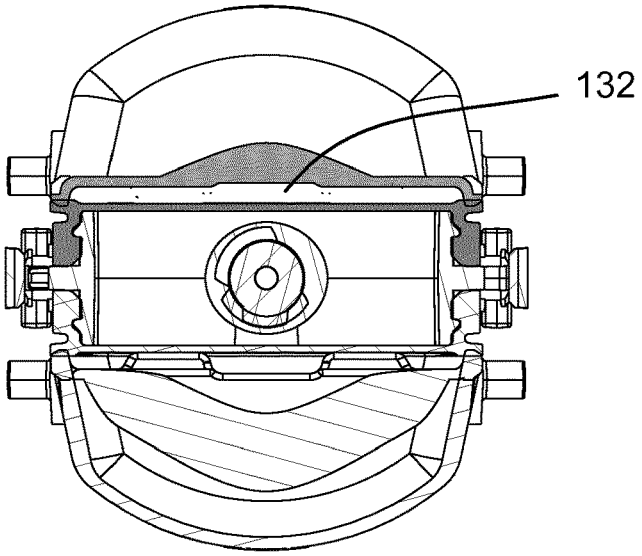
FIGS. 22 and 23 show cross sectional views as defined by lines XXII-XXII and XXIII-XXIII in FIG. 21.
Figure 23:
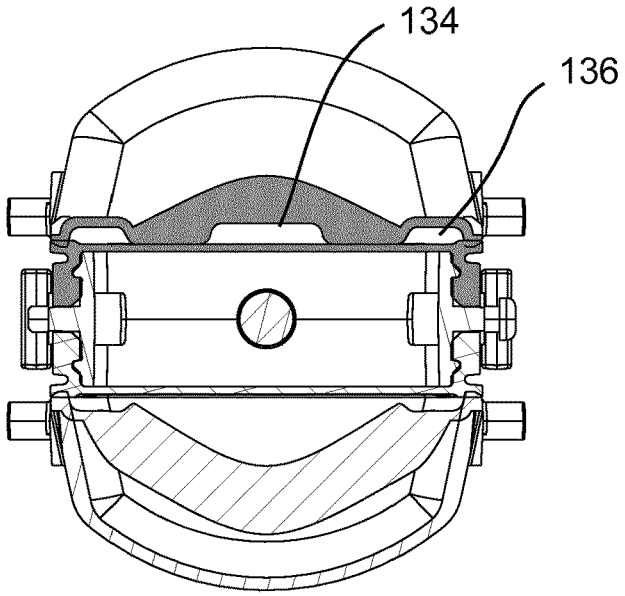

From FIGS. 22 and 23, the shape of the openings between the compartments can be seen in more detail. For the sake of clarity, some of the components have been removed to more clearly highlight the openings. The upper dark portion is the cross section of the tray and the lower dark portion is the cross section of the seal. In the embodiment shown, the upper opening is provided as one large broad opening. In this way, water can flow through the opening at some point and air can exit at another point. In the lowermost opening, the opening is split into three regions, a central larger region for water and two side regions for air. Or one side region and the central region could be used for water and the other side region could be used for air.

As can be seen, the uppermost compartment has a larger opening than the lowermost compartment. In another embodiment, it could be imagined that the uppermost compartment had the smallest opening and each opening became larger towards the bottom. This would again force the lower trays to fill faster than the upper trays.

With regards to the wording in the claims, it can be noted that the filling passage as discussed in the claims comprises the first opening 122, the chamber 128 and the second opening 130. The total flow coefficient of this combination should be compared to the flow coefficient of the distribution passage 132,134,136 between the compartments. Likewise, the air vent chimney 126 is connected to the chamber 128 in the filling passage between the first opening and the second opening. Air exiting the tray through the second opening, therefore enters the chamber and can exit the chamber via the air venting chimney without interfering with the water entering through the first opening.

It should be noted that in another embodiment, only a single opening is provided for filling water into the tray and a second separate opening is provided for venting air. Water will therefore enter the tray via the first opening and air leave via the second opening. In this situation, there is no need for the two openings with the chamber between. However, it will be necessary to plug two holes in the tray instead of just one. In the solution shown in the figures, there is only one hole in the tray and therefore it is only necessary to plug one hole instead of two.

We again refer to the applicant's previous patent application WO2016/055495, which also discusses different options with regards to solving the air/water conflict inside the trays during filling. The techniques disclosed in the previous application can be combined with the techniques disclosed in this application.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the container according to the current invention.

The invention claimed is:

1. An ice cube dispensing unit comprising a. a housing suitable for containing at least two ice cubes, and b. a dispensing mechanism arranged at one end of the housing, c. characterized in that said dispensing mechanism comprises i. an opening which is large enough for the ice cubes to pass through, ii. a wall arranged near an edge of the opening, and iii. an ice cube displacing mechanism suitable for displacing the ice cubes out of the housing through said opening, said displacing mechanism comprising a driving element which is a form of element which drives the ice cubes downwardly, d. in that said ice cube displacing mechanism and said wall are arranged such that the ice cubes pass between the wall and the driving element of the ice cube displacing mechanism on their way out of the housing, e. in that said ice cube displacing mechanism is arranged at a distance from the wall such that the minimum distance A between the wall and an outer periphery of the driving element of the ice cube displacing mechanism is less than the minimum dimension of the ice cubes, and f. in that either the wall and/or the outer periphery of the driving element of the ice cube displacing mechanism is displaceable to allow the distance A to increase to allow ice cubes to leave the housing.

2. An ice cube dispensing unit according to claim 1, characterized in that the ice cube displacing mechanism engages a side portion of the ice cubes, and displaces the ice cube downwardly when the ice cube displacing mechanism is activated.

3. An ice cube dispensing unit according to claim 1, characterized in that the ice cube displacing mechanism and/or the wall are formed of flexible materials which deflect when they come into contact with the surfaces of the ice cube.

4. An ice cube dispensing unit according to claim 1, characterized in that the ice cube displacing mechanism comprises a rotating driving element comprising a hub portion and a number of flanges arranged in a radial pattern around the hub portion and in that the rotating driving element is arranged to rotate about an axis which is perpendicular to the motion of the ice cubes through the dispensing mechanism when drive by the driving element.

5. An ice cube dispensing unit according to claim 1, characterized in that the ice cube displacing mechanism comprises a rotating driving element comprising a helical flange arranged about the longitudinal axis of the rotating drive element and in that the rotating driving element is arranged to rotate about an axis which is essentially parallel to the motion of the ice cubes through the dispensing mechanism.

6. An ice cube dispensing unit according to claim 1, characterized in that the ice cube displacing mechanism comprises a linear displacing driving mechanism which comprises a reciprocating motion along a direction which has a component which is parallel to the plane of the wall near the opening.

7. An ice cube dispensing unit according to claim 1, characterized in that the distance A is greater than 5 mm, greater than 10 mm or greater than 15 mm.

8. An ice cube dispensing unit according to claim 1, characterized in that the dispensing mechanism further comprises a second opening, wherein the opening and the second opening are on either side of the ice cube displacing mechanism and a second wall, wherein the wall and second wall are on each side of the ice cube displacing mechanism.

9. An ice cube dispensing unit according to claim 1, characterized in that the ice cube displacing mechanism is arranged to be displaceable away from the wall and/or in that the wall is arranged to be displaceable away from the ice cube displacing mechanism to increase the distance A.

10. An ice cube dispensing unit according to claim 1, characterized in that the ice cube displacing mechanism comprises a driving element made from a pliable plastic material such that the driving element deforms when an ice cube passes the driving element.

* * * * *